US010030371B2

(12) United States Patent
Ciavarella et al.

(10) Patent No.: US 10,030,371 B2
(45) Date of Patent: Jul. 24, 2018

(54) SYSTEMS AND METHODS FOR CONTROLLING A PLURALITY OF TOUCH-FREE DEVICES IN A COORDINATED MANNER

(71) Applicant: GOJO Industries, Inc., Akron, OH (US)

(72) Inventors: Nick E. Ciavarella, Seven Hills, OH (US); John J. McNulty, Broadview Heights, OH (US); Jackson W. Wegelin, Stow, OH (US)

(73) Assignee: GOJO Industries, Inc., Akron, OH (US)

( * ) Notice: Subject to any disclaimer, the term of this patent is extended or adjusted under 35 U.S.C. 154(b) by 255 days.

(21) Appl. No.: 14/304,363

(22) Filed: Jun. 13, 2014

(65) Prior Publication Data

US 2014/0366264 A1 Dec. 18, 2014

Related U.S. Application Data

(60) Provisional application No. 61/834,591, filed on Jun. 13, 2013.

(51) Int. Cl.
*E03C 1/04* (2006.01)
*A47K 5/12* (2006.01)
(Continued)

(52) U.S. Cl.
CPC ..... *E03C 1/0404* (2013.01); *A47K 5/1217* (2013.01); *A47K 10/48* (2013.01); *E03C 1/057* (2013.01); *A47K 2210/00* (2013.01)

(58) Field of Classification Search
CPC ..... E03C 1/055–1/057; E03C 1/046–1/0465
(Continued)

(56) References Cited

U.S. PATENT DOCUMENTS 3,639,920 A * 2/1972 Griffin ..... E03C 1/057 4/304
5,966,753 A * 10/1999 Gauthier ..... A47K 5/12 4/623

(Continued)

FOREIGN PATENT DOCUMENTS

WO 96/41058 A1 12/1996
WO 03/106772 A1 12/2003

OTHER PUBLICATIONS

International Search Report and Written Opinion from International Application No. PCT/US2014/042030, dated Sep. 22, 2014.

*Primary Examiner* — Erin Deery
*Assistant Examiner* — Nicholas Ros
(74) *Attorney, Agent, or Firm* — Calfee, Halter & Griswold LLP

(57) ABSTRACT

Exemplary embodiments of touch-free devices and systems comprising touch-free devices operating in a concerted effort are disclosed below. An exemplary touch-free device includes a spout, a processor, memory, an object sensor, a communication interface and logic stored on the memory. The logic contains processor readable instructions for causing the touch-free device to communicate with a second touch-free device. Wherein the processor readable instructions coordinate the operation of the touch-free device with respect to the second touch-free device.

20 Claims, 6 Drawing Sheets

(51) Int. Cl.
*A47K 10/48* (2006.01)
*E03C 1/05* (2006.01)

(58) Field of Classification Search
USPC ..... 4/623, 628; 700/282
See application file for complete search history.

(56) References Cited

U.S. PATENT DOCUMENTS

| | | | | |
|---|---|---|---|---|
| 6,236,953 | B1 * | 5/2001 | Segal | G07C 1/10 702/127 |
| 6,426,701 | B1 * | 7/2002 | Levy | G08B 21/24 137/552.7 |
| 7,304,569 | B2 * | 12/2007 | Marcichow | E03C 1/057 340/3.1 |
| 2011/0271441 | A1 * | 11/2011 | Bayley | A47K 10/48 4/638 |

* cited by examiner

SYSTEMS AND METHODS FOR CONTROLLING A PLURALITY OF TOUCH-FREE DEVICES IN A COORDINATED MANNER

RELATED APPLICATIONS

This application claims priority to and the benefits of U.S. Provisional Patent Application Ser. No. 61/834,591 filed on Jun. 13, 2013 and entitled "Systems And Methods For Controlling A Plurality Of Touch-Free Devices In A Coordinated Manner," which is incorporated herein by reference in its entirety.

TECHNICAL FIELD

The present invention relates generally to operating methods and systems that include a plurality of touch-free devices in a coordinated manner and more particularly for controlling hand wash stations having a plurality of touch-free devices such as faucets, soap dispensers and hand dryers.

BACKGROUND OF THE INVENTION

Touch-free devices such as faucets, soap dispensers and hand dryers are very popular because they are more hygienic and than their manual counterparts. The touch-free devices typically have an object sensor located proximate the touch-free device. The object sensors may be infrared based, capacitance based, proximity based or the like. When multiple touch-free devices are used in close proximity, such as, for example around a sink bowl, the touch-free devices often falsely trigger, and, for example, the soap dispenser dispenses soap while the user is rinsing her hands. False triggering wastes soap, leaves a mess in the sink and sometimes dispense soap on a users shirt sleeves. Another example of false triggering occurs when the user is trying to obtain a dose of soap and the faucet turns on and soaks the user's shirt sleeve. Recently, hand dryers have also been located proximate the water faucet and soap dispensers adding to the risk of accidental, or false triggering.

SUMMARY

Exemplary embodiments of touch-free devices and systems comprising touch-free devices operating in a concerted effort are disclosed below. An exemplary touch-free device includes a spout, a processor, memory, an object sensor, a communication interface and logic stored on the memory. The logic contains processor readable instructions for causing the touch-free device to communicate with a second touch-free device. The processor readable instructions coordinate the operation of the touch-free device with respect to the second touch-free device.

An exemplary touch-free dispensing system includes a touch-free faucet, a touch-free soap dispenser and communications circuitry for allowing the touch-free faucet to communicate with the touch-free soap dispenser. The exemplary system includes memory having logic stored on the memory. The logic contains processor readable instructions for coordinating operation of the faucet and operation of the soap dispenser.

Exemplary methods of controlling a touch-free systems are also disclosed herein. One exemplary system includes a faucet and a touch-free soap dispenser. The method includes providing logic on a processor readable medium for preventing the touch-free faucet and the touch-free soap dispenser from operating at the same time.

BRIEF DESCRIPTION OF THE DRAWINGS

These and other features and advantages of the present invention will become better understood with regard to the following description and accompanying drawings in which.

DETAILED DESCRIPTION

"Circuit communication" as used herein indicates a communicative relationship between devices. Direct electrical, electromagnetic and optical connections and indirect electrical, electromagnetic and optical connections are examples of circuit communication. Two devices are in circuit communication if a signal from one is received by the other, regardless of whether the signal is modified by some other device. For example, two devices separated by one or more of the following—amplifiers, filters, transformers, optoisolators, digital or analog buffers, analog integrators, other electronic circuitry, fiber optic transceivers or satellites—are in circuit communication if a signal from one is communicated to the other, even though the signal is modified by the intermediate device(s). As another example, an electromagnetic sensor is in circuit communication with a signal if it receives electromagnetic radiation from the signal. As a final example, two devices not directly connected to each other, but both interfacing with a third device, such as, for example, a CPU, are in circuit communication.

Also, voltages and values representing digitized voltages are considered to be equivalent for the purposes of this application, and thus the term "voltage" as used herein refers to either a signal, or a value in a processor representing a signal, or a value in a processor determined from a value representing a signal.

"Signal," as used herein includes, but is not limited to one or more electrical signals, analog or digital signals, one or more computer instructions, a bit or bit stream, or the like.

"Logic," synonymous with "circuit" includes, but is not limited to hardware, firmware, software and/or combinations of each to perform a function(s) or an action(s). For example, based on a desired application or needs, logic may include a software controlled microprocessor or microcontroller, discrete logic, such as an application specific integrated circuit (ASIC) or other programmed logic device. Logic may also be fully embodied as software. The circuits identified and described herein may have many different configurations to perform the desired functions.

Values identified in the detailed description are exemplary and they are determined as needed for a particular system. Accordingly, the inventive concepts disclosed and claimed herein are not limited to the particular values or ranges of values used to describe the embodiments disclosed herein.

Figure 1:
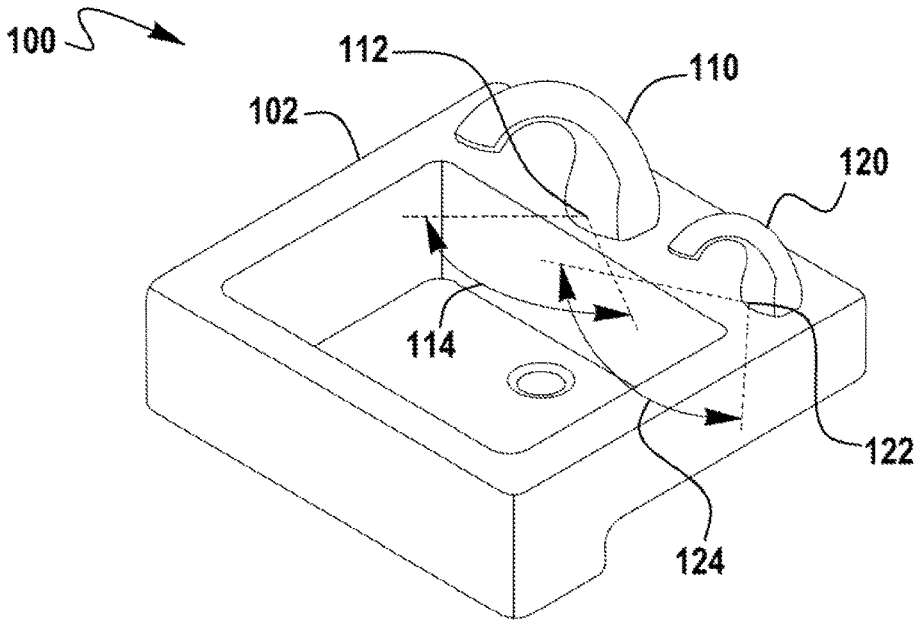
FIG. 1 is prospective view of an exemplary system having a touch-free faucet and a touch-free soap dispenser secured to a sink.

FIG. 1 illustrates an exemplary embodiment of a system 100 having a plurality of touch-free devices that operate in a coordinated fashion. The first touch-free device is a faucet 110. Faucet 110 is secured to sink 102 and includes an object sensor 112. Object sensor 112 has a viewing window 114. In some embodiments, viewing window 114 has a conical shape. System 100 includes a second touch-free device that is a soap dispenser 120. Soap dispenser 120 is secured to sink 102 and includes an object sensor 122. Object sensor 122 has a viewing window 124. In some embodiments, viewing window 124 has a conical shape.

As can be seen in FIG. 1, viewing windows 114 and 124 overlap one another. Accordingly, if a user's hand is located within the overlapping area, both object sensor 112 and object sensor 122 will detect the user's hand. In such instances, prior art faucets would turn on and prior art soap dispensers would dispense soap. However, as described in detail below, in embodiments of the present invention, faucet 110 and soap dispenser 120 are in circuit communication with a controller that determines which touch-free device should operate.

Figure 2:
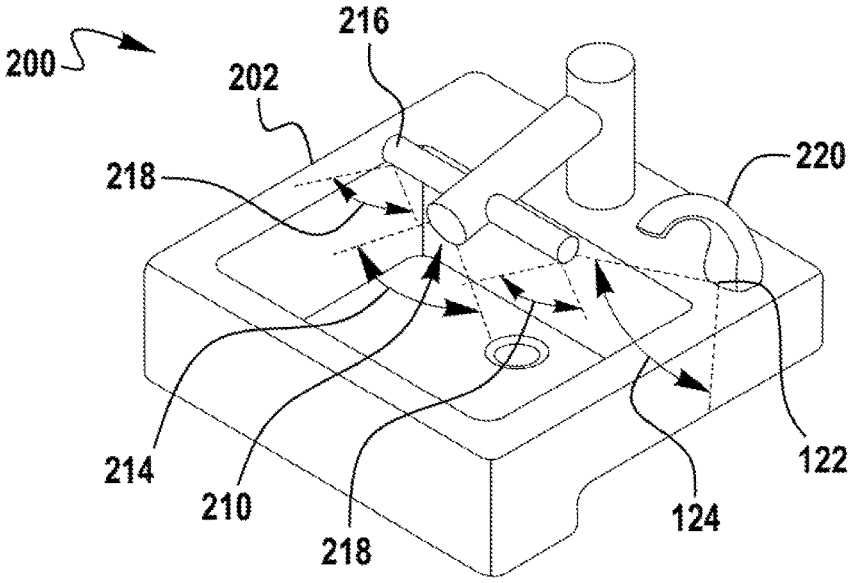
FIG. 2 is prospective view of an exemplary system having a touch-free faucet, a touch-free hand dryer and a touch-free soap dispenser secured to a sink.

FIG. 2 illustrates an exemplary embodiment of a system 200 having three touch-free devices that operate in a coordinated fashion. The first touch-free device is a faucet 210. Faucet 210 is secured to sink 202 and includes an object sensor (not shown). The object sensor has a viewing window 214. In some embodiments, viewing window 214 has a conical shape. System 200 also includes a pair of cylindrical hand dryers 216 extending outward from faucet 210. Cylindrical hand dryers 216 include one or more object sensors that have a viewing window 218. In addition, system 200 includes a second touch-free device that is a soap dispenser 220. Soap dispenser 220 is secured to sink 202 and includes an object sensor 222. Object sensor 222 has a viewing window 224. In some embodiments, viewing window 224 has a conical shape.

Figure 3:
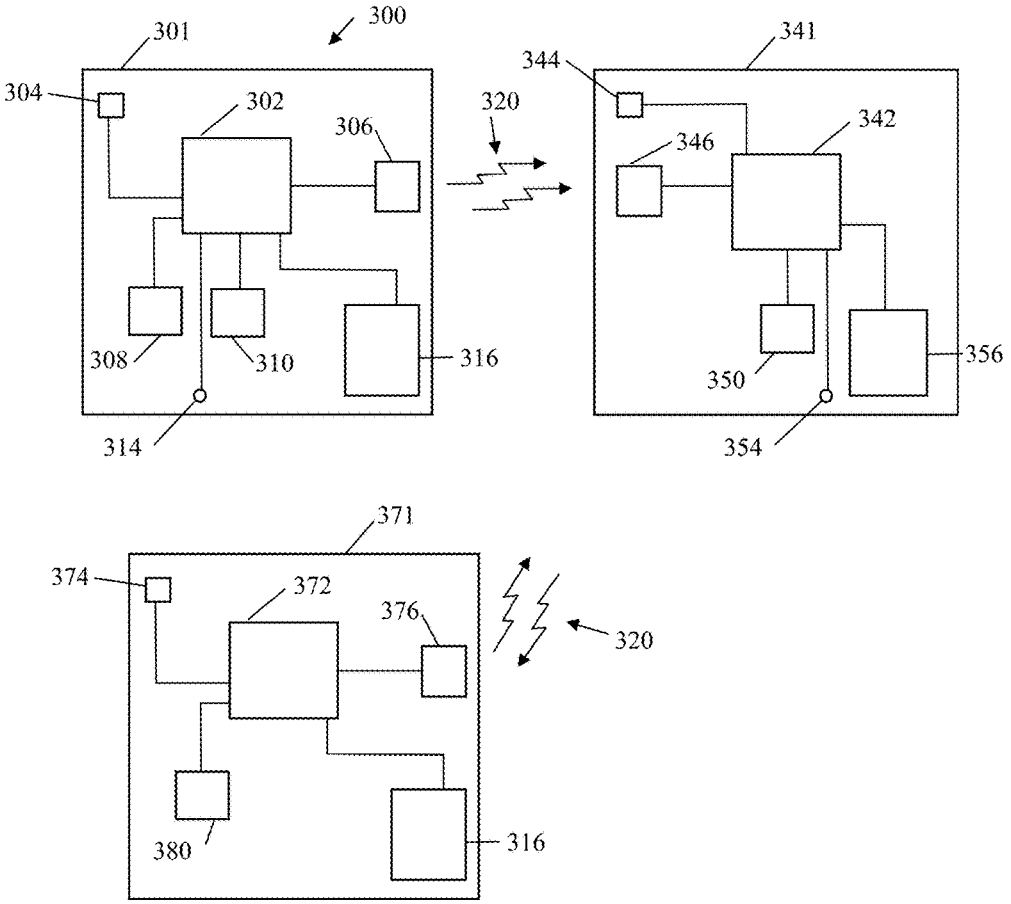
FIG. 3 is a schematic view of exemplary circuitry for three touch-free devices that work together as a system.

As can be seen in FIG. 2, viewing windows 214, 218 and 224 overlap one another. Accordingly, if a user's hand is located within the overlapping area, multiple object sensors will detect the user's hand. In such instances, prior art faucets, hand dryers and prior art soap dispensers might be activated at the same time. However, as described in detail below, in embodiments of the present invention, faucet 210, hand dryers 216 and soap dispenser 220 are in circuit communication with a controller that determines which touch-free device should operate FIG. 3 illustrates a system 300 having a plurality of touch-free devices in circuit communication with one another. First touch-free device 301 is a faucet. Touch-free device 301 includes control circuitry 302, which includes a processor and memory. An object sensor 304 is in circuit communication with control circuitry 302. Object sensor 304 detects when objects within its viewing range. Touch-free device 301 includes water temperature controller 308, water on-off circuitry 310, an indicator light 314, power supply 316 and communication circuitry 306. All of which are in circuit communication with control circuitry 302, and/or one another. Power supply 316 may be any power supply, such as, for example, one or more batteries. In some embodiments, power supply 316 receives power from a power source, such as, for example, 120 VAC, and power supply 316 may include a transformer, rectifier, power conditioning circuitry or other required circuitry known to those in the art.

Communication circuitry 306 is a wireless transmitter/receiver. The wireless transmitter/receiver may use radio frequency (RF), infrared, Bluetooth, Wi-Fi, optical coupling or the like. In addition, the transmitter/receiver may use any communication protocol. In some embodiments, multiple touch-free devices may be paired with one another to prevent confusions between multiple systems located in near proximity of one another. Thus, the touch-free devices may be grouped into relevant systems. In addition, in some embodiments, the touch-free devices may be connected to one another through one or more cables, i.e. "hardwired."

Second touch-free device 341 is a soap dispenser. Touch-free device 341 includes control circuitry 342, which includes a processor and memory. An object sensor 344 is in circuit communication with control circuitry 342. Object sensor 344 detects when objects within its viewing range. The soap dispenser includes an actuator 350 for actuating a soap pump, an indicator light 344 for indicating a status of the dispenser, power supply 346 and communication circuitry 346. All of which are in circuit communication with control circuitry 342. As described above, power supply 316 may be any type of power supply. Communication circuitry 346 is a wireless transmitter/receiver as described above or may be hardwired to the other touch-free devices in the system.

Third touch-free device 371 is a hand dryer. Touch-free device 371 includes control circuitry 372, which includes a processor and memory. An object sensor 374 is in circuit communication with control circuitry 372. Object sensor 374 detects when objects within its viewing range. The hand dryer includes an actuator 380 for actuating the hand dryer, power supply 376 and communication circuitry 376. All of which are in circuit communication with control circuitry 372. Power supply 376 is preferably 120 VAC power source, but may be any type of power supply as described above. Communication circuitry 376 is a wireless transmitter/receiver as described above or may be hardwired to the other touch-free devices in the system. Communications signals 320 allow the three touch-free devices to communicate with one another.

Logic for controlling the system may be located in separate control circuitry or may be located in memory of any control circuitry in the system. In this exemplary embodiment, the logic described herein is located in the control circuit of the faucet because, although not required to be included in the system, the faucet is included in each of the embodiments of systems described herein.

Figure 4:
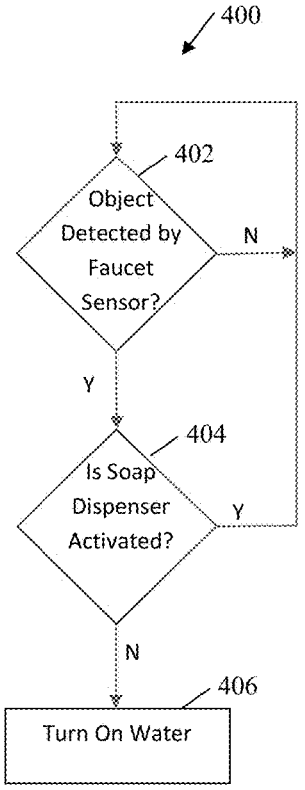
FIG. 4 is a flow chart of exemplary logic for a faucet and soap dispenser system to enable turning on of the water.

FIG. 4 illustrates an exemplary embodiment of logic 400 for controlling a faucet and a soap dispenser. At block 402, the processor determines whether an object has been detected by the faucet sensor. If no object has been detected, the logic loops back and determines whether an object has been detected by the faucet sensor. If an object is detected, the processor determines if the soap dispenser is activated at block 404, if the soap dispenser has been activated, the logic returns to block 402. If the soap dispenser has not been activated, the processor turns on the water at block 406.

Figure 5:
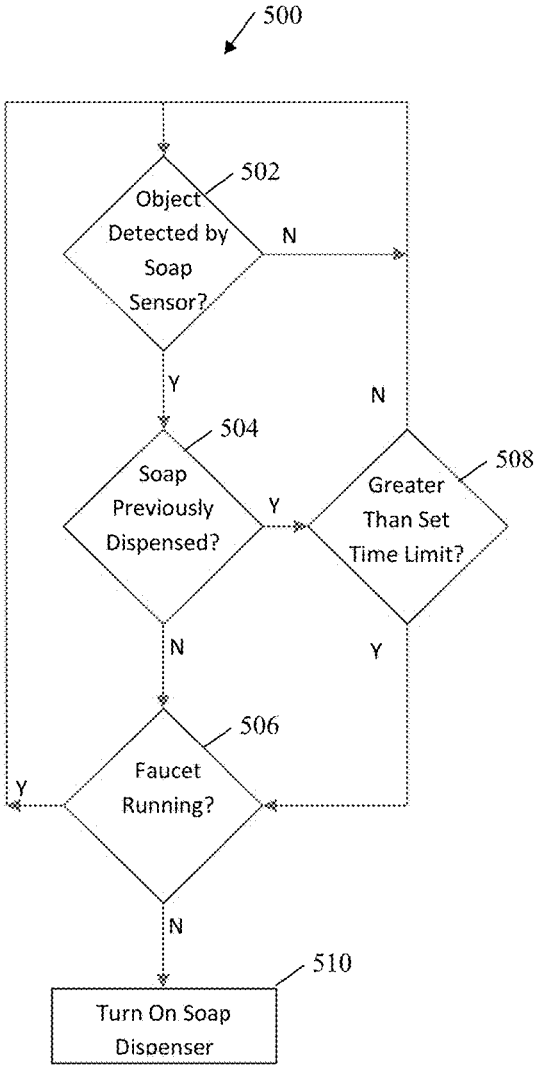
FIG. 5 is a flow chart of exemplary logic for a faucet and soap dispenser system to enable turning on of the soap dispenser.

FIG. 5 illustrates an exemplary embodiment of logic 500 for controlling a faucet and soap dispenser. At block 502, the processor determines whether an object has been detected by the soap detector. If no object has been detected, the processor loops back to block 502 and determines whether an object has been detected. If an object has been detected, the processor determines whether the soap dispenser has previously dispensed at block 504. If it has previously dispensed, the processor determines if the time since last dispense was within one or more predetermined time limits at block 508. The predetermined time limits may be used to allow a user to obtain multiple shots of soap in a close period of time, but prevent the soap dispenser from dispensing soap if the time is outside of the time limits to prevent accidental triggering of the soap dispenser. For example, the predetermined time limits may contain a first range, from 0 to 3 seconds. If the object is held under the object sensor for 0-3 seconds, multiple shots will be dispensed. If the time is outside of the time limits, no soap is dispensed and the soap previously dispensed status is reset after a predetermined period of time. If the processor determines that the soap has not been previously dispensed or determines that it is within a predetermined period of time, the processor determines whether the faucet is running at block 506. If the faucet is not running, soap is dispensed at block 510. If the faucet is running, the logic loops back to block 502.

Figure 6:
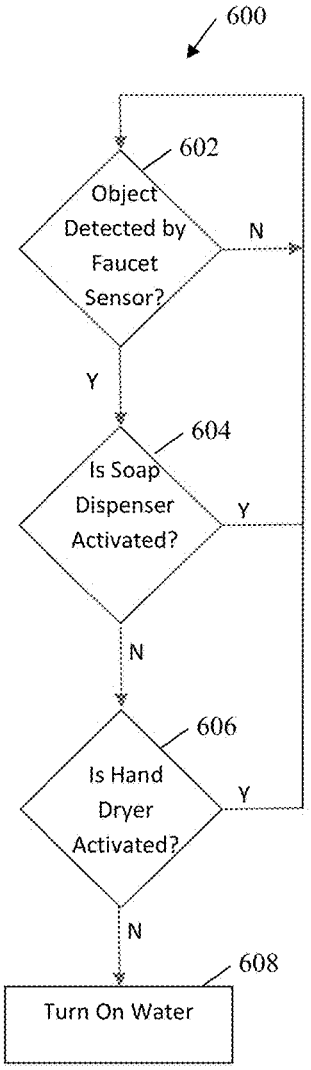
FIG. 6 is a flow chart of exemplary logic for a faucet, soap dispenser and hand dryer system to enable turning on of the water.

FIG. 6 illustrates an exemplary embodiment of logic 600 for a system having a faucet, a soap dispenser and a hand dryer. At block 602 the processor determines whether an object is detected by the faucet sensor. If no object is detected, the logic loops back to block 602. If an object is detected, the processor determines whether the soap dispenser is being activated at block 604. If the soap dispenser is being activated, the logic loops back to block 602. If the soap dispenser is not being activated, the processor determines whether the hand dryer is activated at block 606. If the hand dryer is being activated, the logic loops back to block 602. If the hand dryer is not being activated, the water is turned on at block 608.

Figure 7:
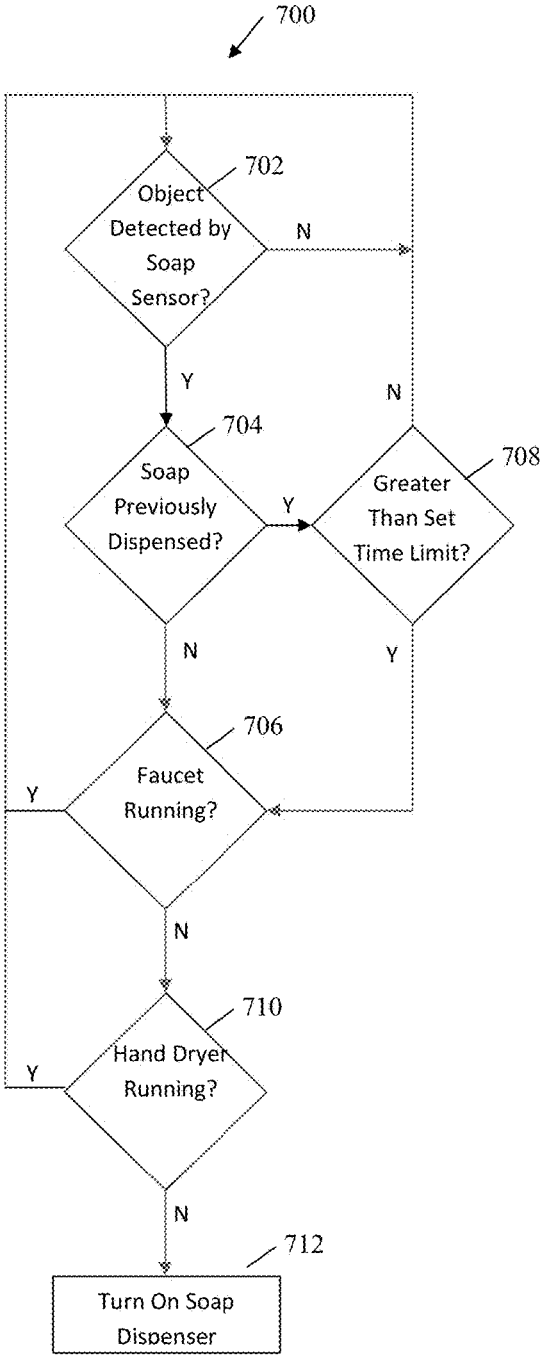
FIG. 7 is a flow chart of exemplary logic for a faucet, soap dispenser and hand dryer system to enable turning on of the soap dispenser.

FIG. 7 illustrates an exemplary embodiment of logic 700 for a system having a faucet, a soap dispenser and a hand dryer. At block 702, the processor determines whether an object is detected by the soap dispenser sensor. If no object has been detected, the processor loops back to block 702 and determines whether an object has been detected. If an object has been detected, the processor determines whether the soap dispenser has previously dispensed at block 704. If it has previously dispensed, the processor determines if the time since last dispense was within one or more predetermined time limits at block 708. The predetermined time limits may be used to allow a user to obtain multiple shots of soap in a close period of time, but prevent the soap dispenser from dispensing soap if the time is outside of the time limits to prevent accidental triggering of the soap dispenser. For example, the predetermined time limits may contain a first range, from 0 to 3 seconds. If the object is held under the object sensor for 0-3 seconds, multiple shots will be dispensed. If the time is outside of a time limit, no soap is dispensed and the soap previously dispensed status is reset after a predetermined period of time. If the processor determines that the soap has not been previously dispensed or determines that it is within a predetermined period of time, the processor determines whether the faucet is running at block 706. If the faucet is running, the logic loops back to block 702. If the faucet is not running, a determination is made at block 710 to determine whether the hand dryer is running. If it is running, the logic loops back to block 702. If the hand dryer is not running, soap is dispensed at block 710.

Figure 8:
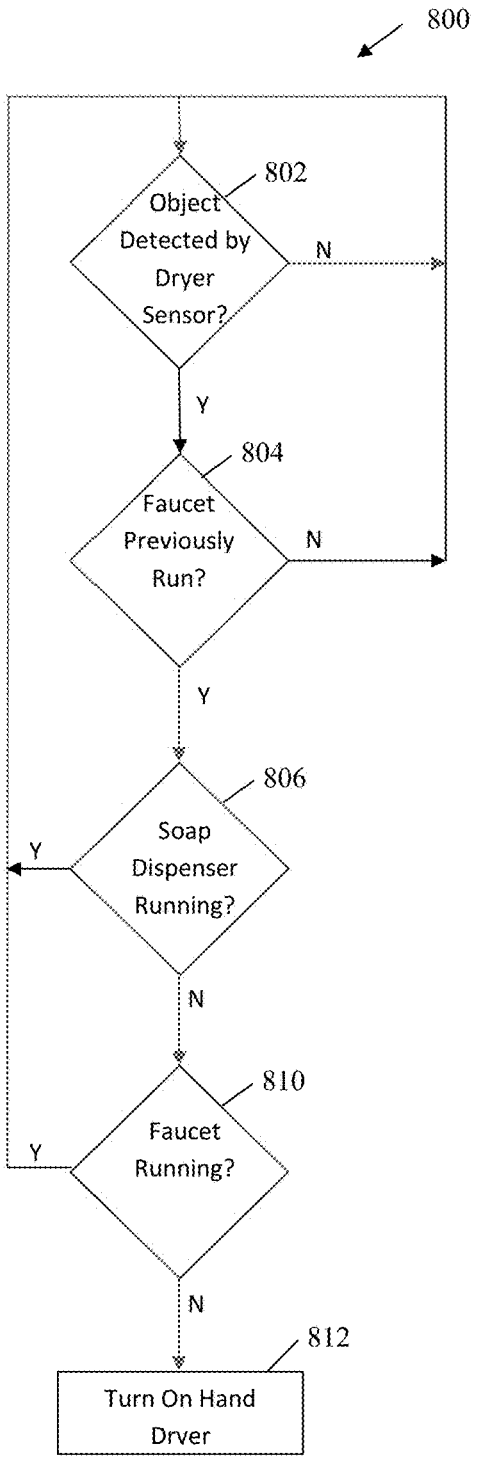
FIG. 8 is a flow chart of exemplary logic for a faucet, soap dispenser and hand dryer system to enable turning on of the hand dryer.

FIG. 8 illustrates an exemplary embodiment of logic 800 for a system having a faucet, a soap dispenser and a hand dryer. The processor determines whether an object is detected by the hand dryer sensor at block 802. If no object has been detected, the logic loops back to block 802. If an object has been detected, the processor determines whether the faucet has been previously run within a predetermined time at block 804. If the faucet has not been run, the logic loops back to block 802. If the faucet has previously been run, the processor determines whether the soap dispenser is being activated at block 806. If the soap dispenser is being activated, the logic loops back to block 802. If the soap dispenser is not running, the processor determines whether the faucet is running at block 810. If the faucet is running the logic loops back to block 802. If the faucet is not running the hand dryer is turned on at block 812.

Figure 9:
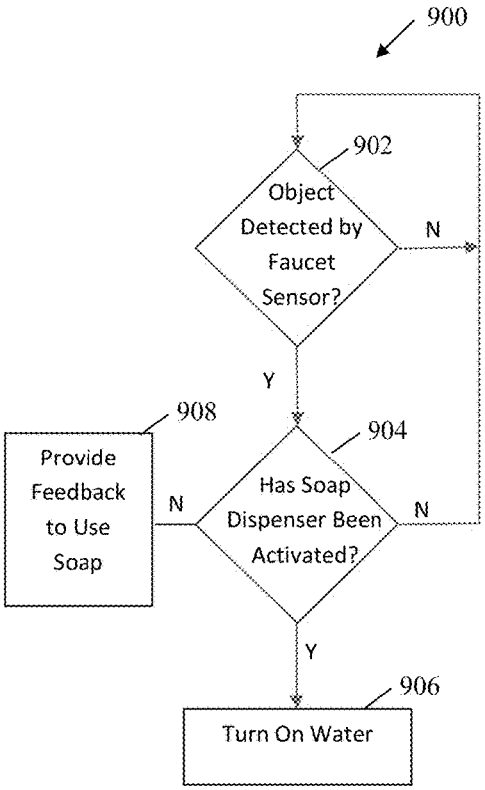
FIGS. 9 and 10 are flow charts of exemplary logic for a faucet and soap dispenser having hygiene compliance logic.

FIG. 9 illustrates an exemplary embodiment of compliance logic 900 for a system having a faucet and a soap dispenser. The processor determines whether an object is detected by the faucet sensor at block 902. If no object is detected, the logic loops back to block 902. If an object is detected, the processor determines whether the soap dispenser has been activated at block 904. If no soap has been dispensed within a set time period, a signal is output to the user to indicate to the user that she needs to obtain soap at block 908. In addition, the logic loops back to block 902. If at block 904 a determination has been made that soap has been dispensed, the water is turned on at block 906. In some embodiments, the water may be turned on for a brief time to allow the user to wet her hands prior to obtaining soap. In such an embodiment, the water would turn on for about 1 second and then feedback would be provided to the user to use soap. The feedback provided to the user may be visual, audible, combinations of the two or any other type of sensory feedback. In some embodiments, the feedback is simply the water not turning on. Thus, the compliance logic 900 ensures that a user use soap when washing their hands.

Figure 10:
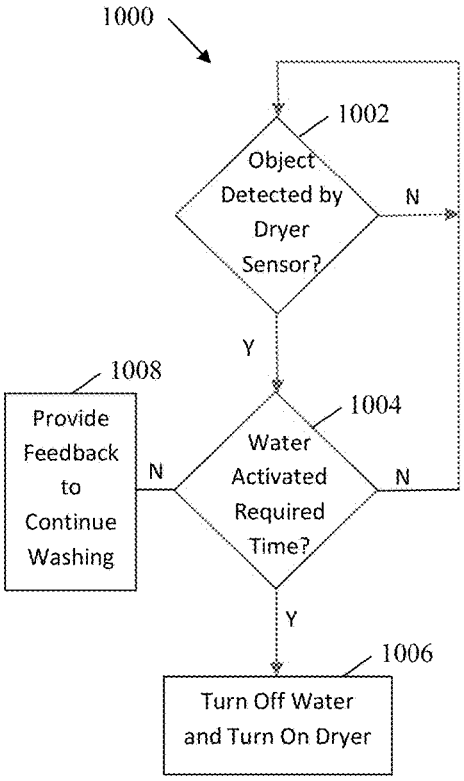

FIG. 10 illustrates an exemplary embodiment of compliance logic 1000 for a system having a faucet, and a hand dryer. The processor determines whether an object is detected by the hand dryer sensor at block 1002. If no object is detected, the logic loops back to block 1002. If an object is detected, the processor determines whether the water has been activated for a minimum required time at block 1004. If the water has not been activated for the required minimum period of time a signal is output to the user to indicate to the user that she needs to continue washing her hands at block 1006. If a determination is made that the water has been on for more than the minimum required time, the water is shut off and the dryer is turned on at block 1006.

The exemplary logic described above may be used as described, all or portions of the logic may be combined together. In additions, portions of the logic may be used alone or with other logic to arrive at systems wherein two or more touch-free devices operate in a concerted manner.

While the present invention has been illustrated by the description of embodiments thereof and while the embodiments have been described in considerable detail, it is not the intention of the applicants to restrict or in any way limit the scope of the appended claims to such detail. Additional advantages and modifications will readily appear to those skilled in the art. Moreover, elements described with one embodiment may be readily adapted for use with other embodiments. Therefore, the invention, in its broader aspects, is not limited to the specific details, the representative apparatus and illustrative examples shown and described. Accordingly, departures may be made from such details without departing from the spirit or scope of the applicants' general inventive concept.

We claim:

1. A touch-free dispensing system comprising:

a touch-free faucet having an first object sensor, wherein the first object sensor has a first sensing range;

a touch-free soap dispenser having an second object sensor, wherein the second object sensor has a second sensing range;

wherein the first sensing range and the second sensing range are configured such that an object may be detected by the first sensing range and the second sensing range while in a stationary position;

the touch-free faucet and the touch-free soap dispenser each having a) a software controlled processor;

b) communication circuitry for allowing the touch-free faucet to communicate with the touch-free soap dispenser; and c) memory;

logic stored on at least one of the touch-free faucet memory and the touch-free soap dispenser memory;

the logic containing software controlled processor readable instructions for coordinating operation of the faucet and operation of the soap dispenser;

wherein the coordinated operation determines whether to activate the touch-free faucet or the touch-free soap dispenser when an object is detected in both the first sensing range and the second sensing range; and wherein the touch-free faucet may be operated at any time when the no object is in the second sensing range and the touch-free soap dispenser may be operated at any time no object is in the first sensing range.

2. The touch-free dispensing system of claim 1 wherein soap is prevented from dispensing while water is being dispensed.

3. The touch-free dispensing system of claim 1 further comprising a hand dryer and logic for coordinating the dispensing of water, soap and air.

4. The touch-free dispensing system of claim 3 further comprising logic for preventing the soap from dispensing when air is being dispensed.

5. The touch-free dispensing system of claim 1 further comprising compliance logic to ensure a user complies with guidelines for washing hands.

6. The touch-free dispensing system of claim 5 wherein the compliance logic prevents the water from running for greater than a set time unless the soap dispenser has dispensed soap.

7. The touch-free dispensing system of claim 6 further comprising an indicator to indicate to a user to use soap.

8. A touch-free device comprising:

a spout;

a software controlled processor;

memory located in the touch-free device;

an object sensor;

a communication interface; and logic stored on the memory;

the logic containing software controlled processor readable instructions for causing the touch-free device to communicate with a second touch-free device;

wherein the object sensor has a first sensing range that is configure to overlap with a second sensing range of a second object sensor associated with the second touch-free-device;

wherein the first sensing range and the second sensing rang are configured such that an object may be detected by the first sensing range and the second sensing range while in a stationary position wherein the software controlled processor readable instructions coordinate the operation of the touch-free device with respect to the second touch-free device;

wherein coordinating the operation of the touch-fee device with respect to the second touch-free device determines whether to activate the first touch-free device or the second touch-free device when an object is detected in both the first sensing range and the second sensing range; and wherein the first touch free device may be operated anytime a sensor in the second touch-free device does not receive an activation signal from a sensor in circuit communication with the second touch-free device;

wherein the second touch free device also comprises a software controlled processer and memory located in the second touch-free device.

9. The touch-free device of claim 8 wherein the touch-free device is one of a soap dispenser, a faucet and a hand dryer.

10. The touch-free device of claim 8 further comprising logic to prevent the touch-free device from operating if a second touch-free device is operating.

11. The touch-free device of claim 8 further comprising a second touch-free device and logic stored on the computer readable medium for determining whether to operate the first touch-free device or the second touch-free device when an object is detected by both touch-free devices.

12. The touch-free device of claim 11 wherein the first touch-free device and the second touch-free device comprise a faucet and a soap dispenser.

13. The touch free device of claim 8 wherein the communication circuitry comprises wireless communication circuitry.

14. The touch-free device of claim 11 wherein the first touch-free device and the second touch-free device comprise a faucet and a hand dryer.

15. The touch-free device of claim 14 further comprising logic to prevent the touch-free hand dryer from operating unless the touch-free faucet has dispensed water.

16. The touch-free device of claim 11 further comprising compliance logic.

17. The touch-free device of claim 16 wherein the compliance logic requires the activation of a touch-free soap dispenser prior to allowing the water to be turned on for more than a set time limit.

18. A method of controlling a touch-free faucet and a touch-free soap dispenser comprising:

providing a touch-free device that is of a touch-free faucet and a touch-free soap dispenser;

wherein the touch-free device has a first object sensor with a first sensing range;

wherein the touch-free device includes a software controlled processor, memory and communication circuitry for communicating with a second touch-free device that is the other of the touch-free faucet and the touch-free soap dispenser that also includes a software controlled processor, memory and communication circuitry and a second object sensor for sensing a second sensing range;

wherein the first sensing range and the second sensing range overlap one another;

providing logic on a processer readable medium for preventing the first touch-free device and the second touch-free device from operating at the same time when an object is detected by a first sensor associated with the touch free device and a second sensor associated with the second touch-free device;

and wherein the logic determines whether to activate the first touch-free device or the second touch-free device when an object is detected in both the first sensing range and the second sensing range and wherein the touch-free device may be operated at anytime that the second sensor does not detect an object.

19. The method of claim 18 further comprising logic on the processor readable medium for determining which touch-free device to activate when object sensors relating to both touch-free devices detect an object.

20. The method of claim 18 further comprising logic on the processor readable medium for controlling a hand dryer.

* * * * *